US005967452A

United States Patent [19]

Wilder

[11] Patent Number: 5,967,452

[45] Date of Patent: Oct. 19, 1999

[54] FLEXIBLE TOILET PAPER HOLDER SYSTEM

[76] Inventor: Dafne M. Wilder, 2995 E. Sunset Rd. I-102, Las Vegas, Nev. 89120

[21] Appl. No.: 09/220,931

[22] Filed: Dec. 24, 1998

[51] Int. Cl.[6] ..... B65H 16/04

[52] U.S. Cl. ..... 242/597.4; 242/592; 242/597.8; D6/519; D6/523

[58] Field of Search ..... 242/592, 597, 242/597.1, 597.2, 597.4, 597.5, 597.8; 4/300.41; 312/34.8; D6/518, 519, 521, 522, 523

[56] References Cited

U.S. PATENT DOCUMENTS

| | | | |
|---|---|---|---|
| D. 265,700 | 8/1982 | Breger et al. . | |
| D. 393,165 | 4/1998 | Jensen | D6/523 |
| 1,069,961 | 8/1913 | Kuczynski | 242/597.4 |
| 1,226,453 | 5/1917 | Boyle | 242/597.4 |
| 2,434,368 | 1/1948 | Pederson | 242/597.4 |
| 2,529,420 | 11/1950 | Ramquist | 242/597.4 |
| 3,370,805 | 2/1968 | Barbee | 242/597.4 |
| 3,834,636 | 9/1974 | Linick . | |
| 4,360,172 | 11/1982 | Cope | 242/597.4 |
| 4,416,425 | 11/1983 | Kish . | |
| 4,500,047 | 2/1985 | Merlin | 242/597.4 |
| 4,553,710 | 11/1985 | Pool . | |
| 4,741,486 | 5/1988 | Ancona et al. | 242/597.4 |
| 5,435,611 | 7/1995 | Campbell et al. | 294/16 |
| 5,437,528 | 8/1995 | Decker | 242/597.4 |
| 5,871,170 | 2/1999 | Morales et al. | 242/597.5 |

*Primary Examiner*—Donald P. Walsh
*Assistant Examiner*—William A. Rivera

[57] ABSTRACT

A flexible toilet paper holder system comprising a coupling assembly formed of a plurality of short links coupled together by pins adjacent to the ends of the links and adapted to allow the coupling assembly to be extended or retracted. Also provided is a rectangular base plate with a hinge that is coupled with an inboard end of the coupling assembly for rotation about a vertical axis. A cylindrical support shaft with a free end supports a stopper to retain a roll of toilet paper on the shaft. The support shaft also has a hinge coupled to the end of the shaft for coupling with an outboard end of the coupling assembly.

7 Claims, 2 Drawing Sheets

FLEXIBLE TOILET PAPER HOLDER SYSTEM

BACKGROUND OF THE INVENTION

1. Field of the Invention

The present invention relates to a flexible toilet paper holder system and more particularly pertains to supporting a roll of toilet paper in a wide variety of orientations.

2. Description of the Prior Art

The use of toilet paper holders of known designs and configurations is known in the prior art. More specifically, toilet paper holders of known designs and configurations heretofore devised and utilized for the purpose of holding a roll of toilet paper by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,834,636 to Linick discloses an Extensible Toilet Tissue Roll. U.S. Pat. No. 4,416,425 to Kish discloses a Paper Roll Dispenser. U.S. Pat. No. 4,553,710 to Pool discloses a Roll Holding Fixture. U.S. Pat. No. Des. 265,700 to Breger et al. discloses a Toilet Paper Dispenser. Lastly, U.S. Pat. No. 5,435,611 to Campbell et al. discloses Aluminum Can Handling Tongs.

In this respect, the flexible toilet paper holder system according to the present invention substantially departs from the conventional concepts and designs of the prior art, and in doing so provides an apparatus primarily developed for the purpose of supporting a roll of toilet paper in a wide variety of orientations.

Therefore, it can be appreciated that there exists a continuing need for a new and improved flexible toilet paper holder system which can be used for supporting a roll of toilet paper in a wide variety of orientations. In this regard, the present invention substantially fulfills this need.

SUMMARY OF THE INVENTION

In view of the foregoing disadvantages inherent in the known types of toilet paper holders of known designs and configurations now present in the prior art, the present invention provides an improved flexible toilet paper holder system. As such, the general purpose of the present invention, which will be described subsequently in greater detail, is to provide a new and improved flexible toilet paper holder system and method which has all the advantages of the prior art and none of the disadvantages.

To attain this, the present invention essentially comprises a new and improved flexible toilet paper holder system for supporting a roll of toilet paper in a wide variety of orientations comprising a coupling assembly formed of a plurality of short links coupled together by pins adjacent to the ends of the links and adapted to allow the coupling assembly to be extended or retracted. The system further includes a rectangular base plate with a hinge for coupling with an inboard end of the coupling assembly for rotation about a vertical axis. Lastly included is a cylindrical support shaft of a length of about 4.5 inches with a free end for supporting a stopper to retain a roll of toilet paper on the shaft. The support shaft also has a hinge coupled to another end thereof for coupling with an outboard end of the coupling assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flexible toilet paper holder system which has all of the advantages of the prior art toilet paper holders of known designs and configurations and none of the disadvantages.

It is another object of the present invention to provide a new and improved flexible toilet paper holder system which may be easily and efficiently manufactured and marketed.

It is further object of the present invention to provide a new and improved flexible toilet paper holder system which is of durable and reliable constructions.

An even further object of the present invention is to provide a new and improved flexible toilet paper holder system which is susceptible of a low cost of manufacture with regard to both materials and labor, and which accordingly is then susceptible of low prices of sale to the consuming public, thereby making such flexible toilet paper holder system economically available to the buying public.

Even still another object of the present invention is to provide a flexible toilet paper holder system for supporting a roll of toilet paper in a wide variety of orientations.

Lastly, it is an object of the present invention to provide a new and improved flexible toilet paper holder system comprising a coupling assembly formed of a plurality of short links coupled together by pins adjacent to the ends of the links and adapted to allow the coupling assembly to be extended or retracted. Also provided is a rectangular base plate with a hinge that is coupled with an inboard end of the coupling assembly for rotation about a vertical axis. A cylindrical support shaft with a free end supports a stopper to retain a roll of toilet paper on the shaft. The support shaft also has a hinge coupled to the end of the shaft for coupling with an outboard end of the coupling assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
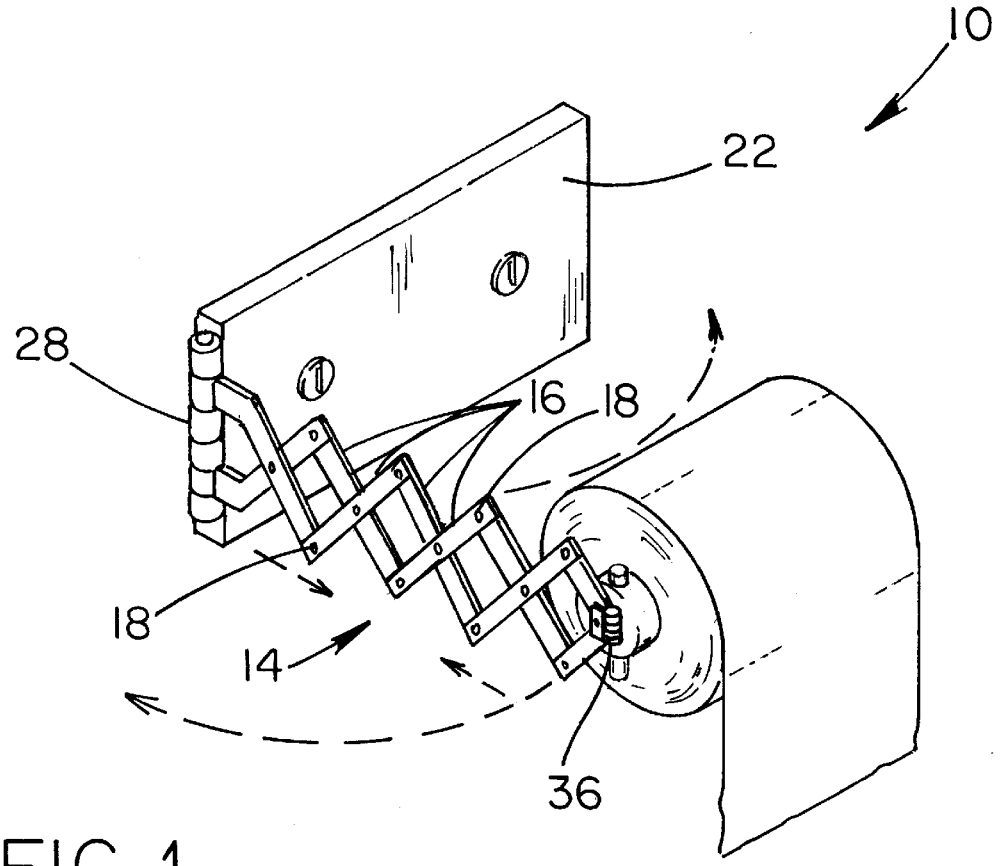
FIG. 1 is a perspective view of the preferred embodiment of the flexible toilet paper holder system constructed in accordance with the principles of the present invention.
Figure 2:
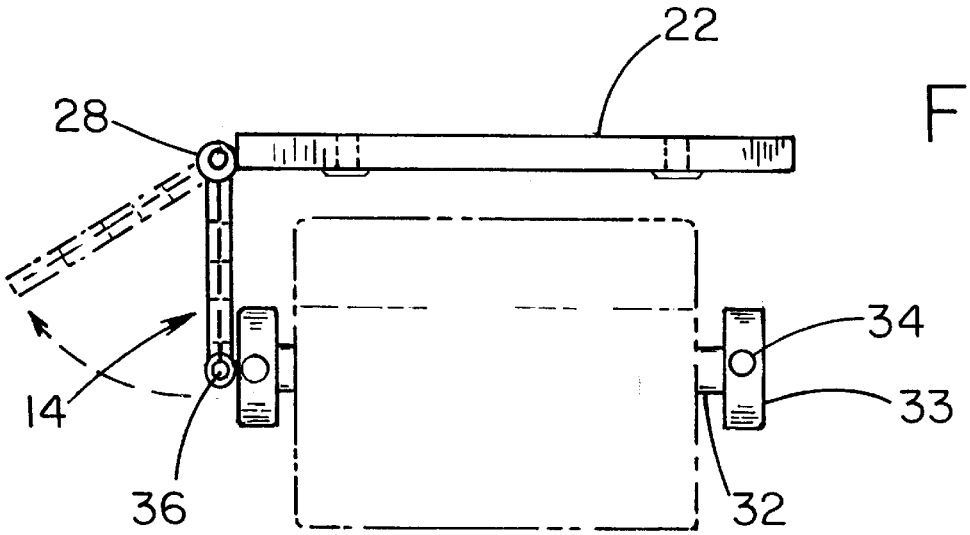
FIG. 2 is a top view of the present invention.
Figure 4:
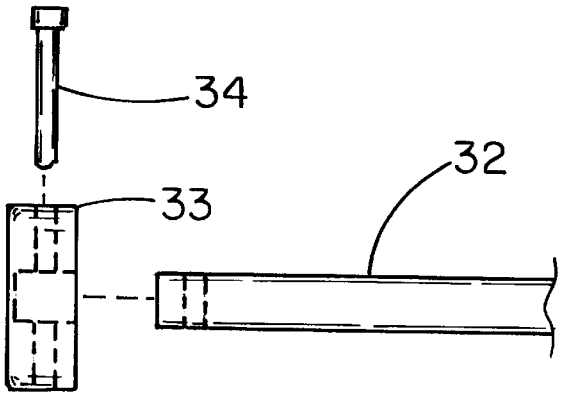
FIG. 4 is an exploded view of the stopper of the present invention.

With reference now to the drawings, and in particular to FIG. 1 thereof, the preferred embodiment of the new and improved flexible toilet paper holder system embodying the principles and concepts of the present invention and generally designated by the reference numeral 10 will be described.

The present invention, the flexible toilet paper holder system 10 is comprised of a plurality of components. Such components are individually configured and correlated with respect to each other so as to attain the desired objective.

More specifically, the new and improved flexible toilet paper holder system 10 for supporting a roll of toilet paper in a wide variety of orientations comprises a coupling assembly 14 formed of a plurality of short links 16 coupled together by pins 18 adjacent to the ends of the links. By this structure, the coupling assembly is adapted to allow the coupling assembly to be extended or retracted. The short links include auxiliary links at ends thereof each having a length which is half that of the remaining links.

The system further includes a rectangular base plate 22 with a pair of spaced bores for being mounted on a recipient surface. The base plate is further equipped with a hinge 28 for coupling with an inboard end of the coupling assembly for allowing the rotation thereof about a vertical axis. The hinge preferably includes a pair of arms pivotally coupled to the base plate. Such arms include a V-shaped outboard portion which is pivotally coupled to the inboard end of the coupling assembly. As specifically shown in FIG. 1, one of the auxiliary links is pivotally coupled to the V-shaped outboard portion while a remaining one of the links is integrally formed and fixed to the V-shaped outboard portion.

Lastly included is a cylindrical support shaft 32 of a length of about 4.5 inches with a free end for supporting a disk-shaped stopper 33 to retain a roll of toilet paper on the shaft. Ideally, the stopper includes a recess formed therein with a diametrically opposed bore positioned through the recess for receiving a pin 34 that extends through a diametrically opposed hole in the shaft. An inboard end of the support shaft is equipped with a disk-shaped stopper mounted thereon. As an option, such stopper may also be equipped with a pin fixedly mounted thereon for constraining axial movement of a roll of toilet paper thereon, as shown in FIG. 1. The support shaft also has a hinge 36 coupled to the inboard end thereof which is in turn coupled to an outboard end of the coupling assembly for allowing the pivoting of the shaft about a vertical axis.

Figure 3:
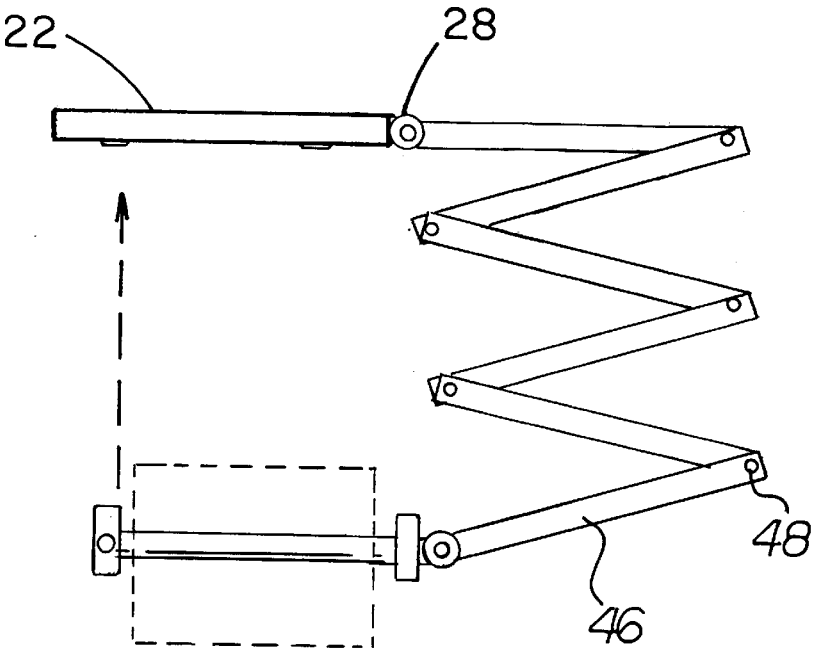
FIG. 3 is a top view of an alternate embodiment of the present invention.

The embodiment of FIG. 3 illustrates yet another alternate embodiment of the invention. In such alternate embodiment, the links 46 are of an extended length as compared with the links of the primary embodiment. There coupled one to another by pins 48. In this manner, the links 46 are simply in a back and forth configuration instead of the crossing configuration as shown in FIG. 1. In either embodiment, it is preferred that the roll of paper is capable of being centered in front of the base plate during use.

In either embodiment, another method of securing the roll of toilet paper in place may be employed. Namely, each end of the shaft may be equipped with a disk having a vertically oriented, diametrically disposed bore formed therein for frictionally receiving a pin which maintains the roll is place. As an option, the pins may be fixed on the ends of the shaft and the shaft may be screwably separated into a pair of halves. It should be noted that any type of convenient securement mechanism may be employed to maintain the roll of toilet paper in place.

As described hereinabove, the present invention consists of a steel bathroom accessory that is easily mounted to an existing toilet paper holder. It features a strong, rust-proof arm that swings and stretches in and out so that a user can comfortably access toilet tissue. The device is designed in two versions; a hat rack style and a folding ruler style. With each version, the arm extends out to the user, and toilet tissue is easily accessible when needed. When empty, the roll could be easily removed with one hand, a new roll replaces the existing roll.

The appealing features of the present invention are its convenience, efficiency, ease of use, durability, attractiveness, effectiveness, and practicality. With this improved holder, toilet paper could be easily accessed and removed without stretching to reach the holder. This houseware product is easily operated by children, adults, the elderly and physically challenged individuals. This unit also provides convenient access to toilet tissue when needed. It eliminates the use of a conventional roll holder, which may be difficult to reach from a sitting position. The present invention is practical, convenient, and durable. Potential places where the present invention may be used include, but are not limited to households, hospitals, offices, hotels, restaurants, shopping centers, or any place where a restroom exists.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A flexible toilet paper holder system for supporting a roll of toilet paper in a variety of orientations comprising, in combination:

a coupling assembly formed of a plurality of links coupled together by pins adjacent to the ends of the links and adapted to allow the coupling assembly to be extended or retracted;

a rectangular base plate with a hinge coupling the base plate and an inboard end of the coupling assembly for rotation about a vertical axis; and a cylindrical support shaft of a length of about 4.5 inches with a free end supporting a stopper to retain a roll of toilet paper on the shaft, the support shaft also having a hinge coupled to another end of the shaft for coupling with an outboard end of the coupling assembly.

2. A flexible toilet paper holder system comprising:

a coupling assembly formed of a plurality of links coupled together by pins adjacent to ends of the link, wherein the coupling assembly is adapted to be extended or retracted, the coupling assembly having a first end coupled to a recipient surface; and a support shaft with a free end for receiving a roll of toilet paper thereon, the support shaft coupled to an outboard end of the coupling assembly;

wherein the coupling assembly is coupled to the recipient surface via a hinge.

3. The system as set fouth in claim 2 wherein the shaft has a stopper mounted on an end thereof for retaining the roll of toilet paper thereon.

4. The system as set fouth in claim 2 wherein the coupling assembly is coupled to the support shaft via a hinge.

5. A flexible toilet paper holder system comprising:

a coupling assembly formed of a plurality of links coupled together by pins adjacent to ends of the link, wherein the coupling assembly is adapted to be extended or retracted, the coupling assembly having a first end for coupling to a recipient surface; and a support shaft with a free end for receiving a roll of toilet paper thereon, the support shaft coupled to an outboard end of the coupling assembly;

wherein the coupling assembly is couplable to the recipient surface via a hinge.

6. The system as set forth in claim 5 wherein the shaft has a stopper mounted on an end thereof for retaining the roll of toilet paper thereon.

7. The system as set forth in claim 5 wherein the coupling assembly is coupled to the support shaft via a hinge.

* * * * *